United States Patent [19]

Wales

[11] Patent Number: 5,050,877

[45] Date of Patent: Sep. 24, 1991

[54] WARM-UP WEIGHT FOR SOFTBALL BAT

[76] Inventor: Alan Wales, 10258 Arrowwood Dr., Eden Prairie, Minn. 55347

[21] Appl. No.: 438,049

[22] Filed: Nov. 20, 1989

Related U.S. Application Data

[63] Continuation of Ser. No. 263,380, Oct. 27, 1988, abandoned.

[51] Int. Cl.[5] ..... A63B 71/00

[52] U.S. Cl. ..... 273/26 B

[58] Field of Search ..... 273/26 B, 26 R, 81 A, 273/67 R, 194 B, 72 R, 194 A, 194 R

[56] References Cited

U.S. PATENT DOCUMENTS

| | | | |
|---|---|---|---|
| 2,608,409 | 8/1952 | Pinkerton | 273/26 B |
| 3,508,748 | 4/1970 | Strimel . | |
| 3,521,883 | 7/1970 | Hamilton . | |
| 3,623,724 | 2/1970 | Lande . | |
| 3,716,239 | 2/1973 | Goudreau | 273/26 B |
| 3,809,397 | 5/1974 | Gruenewald . | |
| 3,834,697 | 6/1974 | McNamara, Jr. et al. | 273/26 B |
| 3,944,225 | 3/1976 | Greaney | 273/26 B |
| 3,971,559 | 7/1976 | Diforte, Jr. . | |
| 4,260,150 | 4/1981 | Tabet . | |
| 4,330,212 | 5/1982 | McCafferty | 273/26 B |
| 4,364,560 | 12/1982 | Gemmel | 273/26 B |
| 4,634,121 | 6/1987 | Sasaki | 273/26 B |

*Primary Examiner*—Theatrice Brown

*Attorney, Agent, or Firm*—Paul L. Sjoquist

[57] ABSTRACT

The present invention is a warm-up weight for softball bats that includes an open-ended cylindrical, tubular section integrally connected to a conical, tubular section. The conical section may be wedged against a tapering portion of a softball bat while the cylindrical section extends over a hitting, cylindrical, barrel portion of the softball bat. The cylindrical section includes an inner leaf spring cantilevered toward the open end of the cylindrical section.

6 Claims, 2 Drawing Sheets

WARM-UP WEIGHT FOR SOFTBALL BAT

BACKGROUND OF THE INVENTION

This application is a continuation-in-part of a copending application for WARM-UP WEIGHT FOR SOFTBALL BAT, Ser. No. 263,380 filed Oct. 27, 1988 (ABANDONED).

The present invention relates to warm-up weights for bats and more particularly to warm-up weights for softball bats.

A baseball player typically swings a weighted bat or a couple of bats in the on-deck circle for warm-up swings before stepping into the batter's box. It is believed that such a practice enhances a batter's feel and control of a bat swung at the plate.

If a weighted bat is used, it is desirable to place weights on or in the hitting portion of a bat. A bat may be weighted permanently by filling a hollowed-out core with lead. More recently, it has become standard practice to attach a doughnut-like weight to one's favorite bat and to remove the attached weight before stepping into the batter's box. The tapering configuration of a baseball bat allows a doughnut-like warm-up weight to be held in place on the hitting portion, and near the distal end, of the bat. The centrifugal force applied to the doughnut-like weight during the swing of the bat wedges the weight against the tapered portion.

A doughnut-like weight placed on a softball bat unfortunately fails to produce the enhanced feel and control caused by attaching such a weight on a baseball bat. This loss of an advantageous effect flows from a difference in the shapes of the bats. A baseball bat tapers substantially continuously outwardly from its handle to its distal end; even the hitting, larger portion of a baseball bat is conical .In contrast, the hitting, larger portion of a softball bat is cylindrical and defined as the barrel portion. The only portion of a softball bat that is conical is a middle portion tapering outwardly from the handle to the barrel portion. Hence, when a doughnut-like weight is attached to a softball bat, the weight is wedged not on the hitting, barrel portion of the softball, but on the conical portion close to the handle. Such an orientation of a weight produces an unnatural swing which is especially undesirable moments before the batter is to step into the batter's box.

Furthermore, it should be noted that, premised perhaps on protecting spectators from the hazard of a weight flying off non-tapered portions of swinging softball bats, the bylaws of at least two softball organizations prohibit the attachment of any type of weight to a warm-up bat used in the on-deck circle. Pursuant to Rule 7, Section 13(c) of the Amateur Softball Association of America, "[n]othing such as a donut, fan, etc. may be attached to a bat when loosening up." Rule 2, Section 1(B) of the United States Slowpitch Softball Association also states that "[n]othing may be attached to a bat such as a donut, (fan) etc., when loosening up."

The prior art includes doughnut-like and elongate weights. For example, the Hamilton U.S. Pat. No. 3,521,883, issued July 28, 1970, shows a doughnut-like training weight for use with a baseball bat. The doughnut-like training weight is held on the baseball bat through a wedging action existing between the sloping circumferential surface of the baseball bat and an inner peripheral surface of the hole in the weight. Similar doughnut-like weights are shown in U.S. Pat. No. 3,971,559, issued July 27, 1976, to Diforte, Jr., and U.S. Pat. No. 4,260,150, issued Apr. 7, 1981, to Tabet.

Elongate weights are shown in U.S. Pat. No. 3,623,724, issued Nov. 30, 1971, to Lande and U.S. Pat. No. 3,508,748, issued Apr. 28, 1970, to Strimel. The Lande patent discloses a frustoconically-shaped bat balancer that adds weight to a bat but maintains the balance of the bat by adding an equal amount of weight above and below the balance point of the bat. The Strimel patent shows in one embodiment a pair of C-shaped weights connected by a connecting arm; one C-shaped weight is elongate and fits over a cylindrical barrel section while the other C-shaped weight engages the tapered section of a bat to hold the C-shaped weights on the bat. In a second embodiment, Strimel shows a single cylindrical C-shaped weight that protrudes over the barrel section of a bat and is held in place by lock bolts that extend axially to the tapered section of the bat to function as retainer means.

It should be noted that a softball bat is typically an official bat sanctioned by either the United States Slowpitch Softball Association (USSSA) or the Amateur Softball Association of America (ASAA). Rule 2, Section 1, of the USSSA provides that:

> "Sec. 1. THE OFFICIAL BAT shall be round or three sided and measure not more than 34 inches long, and not more than 2¼ inches in diameter at its largest part and its weight shall not exceed 38 ounces. The bat shall have a safety grip of tape, cork, or some other composition material, to facilitate holding the bat, during the batter's swing. The safety grip shall be not less than 10 inches long, nor extend more than 15 inches from the small end, or handle end of the bat.
>
> A. THE BAT shall be made of hard wood, in one piece, or laminated from sections of hard wood bonded together with adhesive in such a way that the grain directions of all the pieces are essentially parallel to the lengths of the bat.
>
> B. THE BAT may also be made of aluminum or other metal tubing, fiberglass, graphite or bamboo. The bat must have a solid handle of the same material which constructs the rest of the bat, but may have an insert at the barrel end. It should conform to the same dimensions of length, weight and diameter as relates to hard wood bats. The knob portion must be welded, or mechanically attached to the bat. This includes the C.P.S.C. approved up-date knobs. The intention of this rule is to outlaw the use of the old one-piece rubber grip (the type grip which includes the knob and is slid over the handle and has no mechanical holding mechanism). The angular-handed bat is legal. Only bats may be used in loosening up (including weighted bats for this purpose). Nothing may be attached to a bat such as do-nut (fan) etc. when loosening up.
>
> C. Authorized BAT manufacturers shall mark their products with the words 'OFFICIAL SOFTBALL' or words to that effect, which will then authorize those bats as legal for league and/or sanction Tournament play.
>
> EFFECTS Sec. 1-A-C. When a BAT does not meet specifications as defined, has flat spots or pronounced dents, or if in the Umpire's judgment the bat has been tampered with, the Umpire shall prohibit the use of the doubtful bat."

Rule 3, Section 1, of the ASAA stipulates that the official bat:

"a. Shall be made of one piece of hardwood, or formed from a block of wood consisting of two or more pieces of wood bonded together with an adhesive in such a way that the grain direction of all pieces is essentially parallel to the length of the bat.

b. Shall be plastic, bamboo, graphite, metal, magnesium or any combination of these materials.

c. Can be laminated, but must contain only wood or adhesive and have a clear finish (if finished).

d. Shall be round or three sided, and shall be smooth. If the barrel end has knurled finish, the maximum surface roughness is no more than 250 if measured by a profilometer, or 4/1000 if measured by a spectrograph.

e. Shall not be more than 34 inches (87.0 cm) long, nor exceed 38 ounces (1100.0 g) in weight.

f. If round, shall not be more than 2¼ inches (6.0 cm) in diameter at its largest part; and if three sided, shall not exceed 2¼ inches (6.0 cm) on the hitting surface. A tolerance of 1/32 inches (0.80 mm) is permitted to allow for expansion on the round bat.

g. If metal, may be angular.

h. Shall not have exposed rivets, pins, rough or sharp edges, or any form of exterior fastener that would present a hazard. A metal bat shall be free of burrs.

i. If metal, shall not have a wooden handle.

j. Shall have a safety grip of cork, tape (not smooth plastic type) or composition material. The safety grip shall not be less than 10 inches (25.0 cm) long and shall not extend more than 15 inches (40.0 cm) from the small end of the bat. A molded finger-formed grip made by the manufacturer, if used, must be permanently attached to the bat. Resin, pine tar, or spray substances placed on the safety grip to enhance the grip, are permissible on the grip only. NOTE: Tape applied to any bat must be continuously spiral. It does not have to be a solid layer of tape. It cannot exceed two layers.

k. If metal, and not made of one piece construction with the barrel end closed, shall have a rubber or vinyl plastic insert firmly secured at the large end of the bat.

l. Shall have a safety knob of a minimum of one-fourth inch protruding at a 90-degree angle from the handle. It can be molded, lathed, welded or permanently fastened. A 'flare or cone' grip attached to the bat will be considered an altered bat.

m. Shall be marked 'OFFICIAL SOFTBALL' by the manufacturer. If the words, 'OFFICIAL SOFTBALL' cannot be read due to wear and tear on the bat, the bat should be declared legal if it is legal in all other aspects.

Beginning in 1987, softball bats used in A.S.A. championship tournament play must be approved by the Equipment Standards Committee. NOTE: Bats with special design features to enhance hit distance will not be allowed. Manufacturers must submit all new designed bats to the A.S A. Equipment Standards Committee for approval prior to sales."

Rule 3, Section 2, of the ASAA dictates that as to warm-up bats:

"No more than two official softball bats, one A.S.A. approved warm-up bat, or a combination of the two—not to exceed two—may be used by the on-deck batter in the on-deck circle. The WARM-UP BAT should meet the following requirements to be approved; a) stamped with one-fourth inch letters WB on either end of the bat or marked in 1" letters the words 'Warm-Up Bat Only' on the barrel end of the bat; b) a minimum weight of 48 ounces 1360.0 g; c) a minimum barrel diameter of 2½ inches (6.0 cm); d) have a safety grip of at least 10 inches (25.0 cm) and no more than 15 inches (40.0 cm) extended from the knob; and/or e) be of one piece construction or a one-piece permanently assembled bat approved by the Equipment Standards Committee."

SUMMARY OF THE INVENTION

An object of the present invention is to produce a readily removable warm-up weight for a softball bat having a hitting, cylindrical barrel portion and a tapered portion.

Another object of the present invention is to produce a warm-up weight that distributes its mass evenly over a preferred section of a softball bat.

Still another object of the present invention is to produce a warm-up weight that wedges itself against the conical portion of a softball bat.

A feature of the present invention is a warm-up weight having a cylindrical, tubular section integrally connected to a conical, tubular section. The cylindrical, tubular section is formed to extend over the cylindrical barrel of a softball bat. The conical, tubular section is formed to fit over and wedge against the conical portion of a softball bat. A boss is integrally connected to a handle end of the conical, tubular section of the warm-up weight.

In operation, an on-deck batter slips the open end of the cylindrical, tubular section over the handle of the bat. He or she may then wedge the conical section of the warm-up weight against the conical portion of the softball bat by tapping the distal end of the bat on the ground. After taking his or her warm-up swings and before stepping into the batter's box, the batter removes the warm-up weight by tapping the handle end of the bat on the ground.

An advantage of the present invention is a readily removable weight for a softball bat that distributes its mass evenly over a hitting portion of the bat and that safely wedges itself to a secure position on the bat.

Another advantage of the present invention is an integral, one-piece, inexpensive, durable warm-up weight for softball bats.

DETAILED DESCRIPTION

Figure 1:
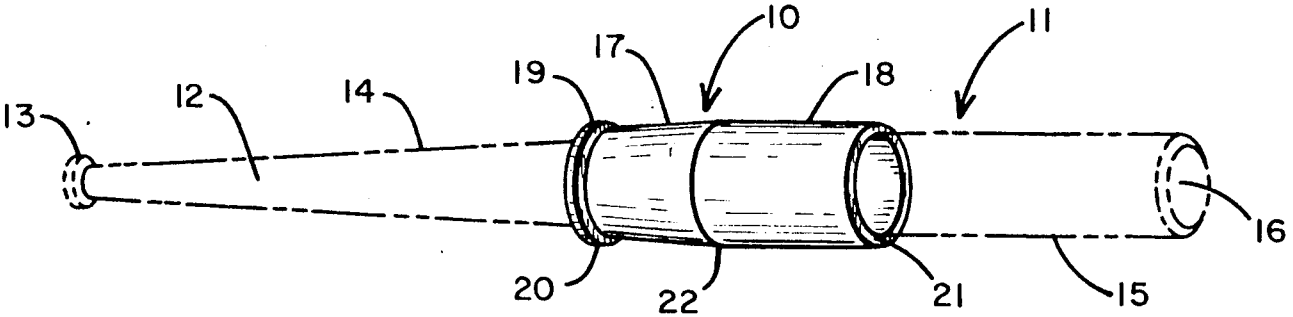
FIG. 1 is an isometric view of the warm-up weight attached to a softball bat.

As shown in FIG. 1, a one-piece, integral, elongate warm-up weight 10 is removably attached to a softball bat 11. The softball bat 11 includes a handle or small end 12 with a knob 13, a conical portion 14 tapering outwardly from the handle end 12, and a cylindrical, barrel distal end 15 having a distal face 16.

The warm-up weight 10 includes an elongate, longitudinal, integral, conical, tubular section 17 integrally connected to an elongate, longitudinal, integral, cylindrical tubular section 18. A laterally extending, integral, annular boss or lip 19 is integrally connected to and extends continuously around a handle end 20 of the conical section 17. A distal end 21 is formed on the cylindrical section 18 opposite the handle end 20. A transitional, central section 22 is formed approximately midway between the annular boss 19 and the distal end 21 where the conical section 17 merges into the cylindrical section 18.

Figure 2:
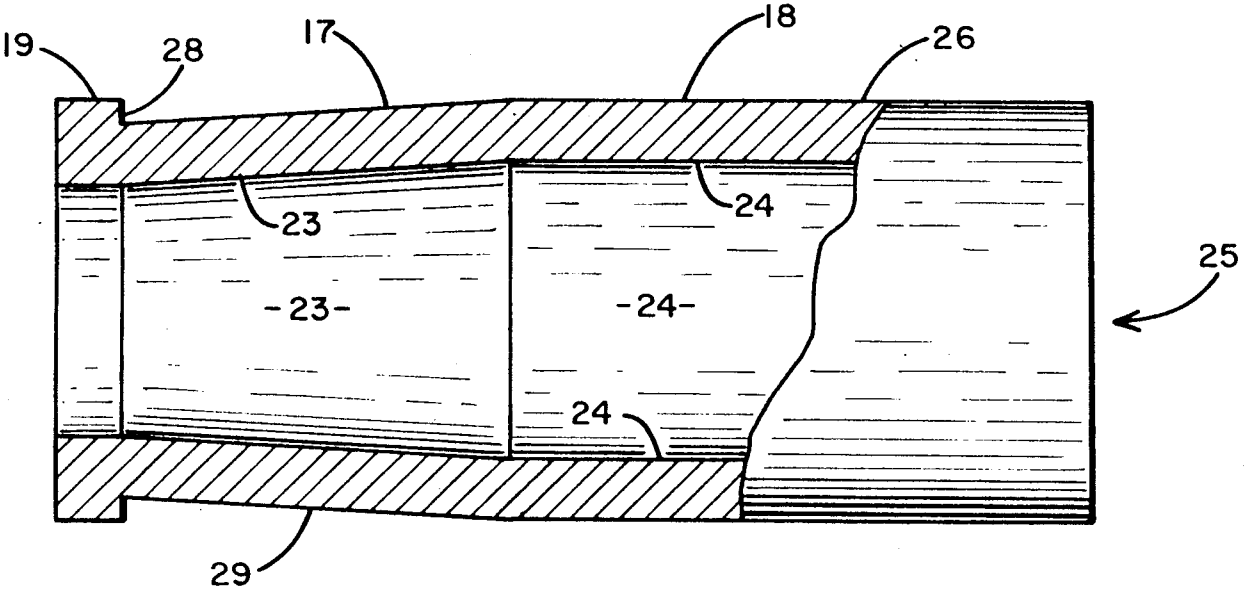
FIG. 2 is a cross-sectional view of the warm-up weight at lines 2—2 of FIG. 1.

As shown in FIG. 2, an inner, peripheral, tapering surface 23 of the conical section 17 and an inner, peripheral, cylinder surface 24 of the cylindrical section 18 form a bat receiving bore 25 for receiving the softball bat 11. An obtuse angle A of approximately 177° is formed between tapering surface 23 and the inner cylinder surface 24.

Figure 4:
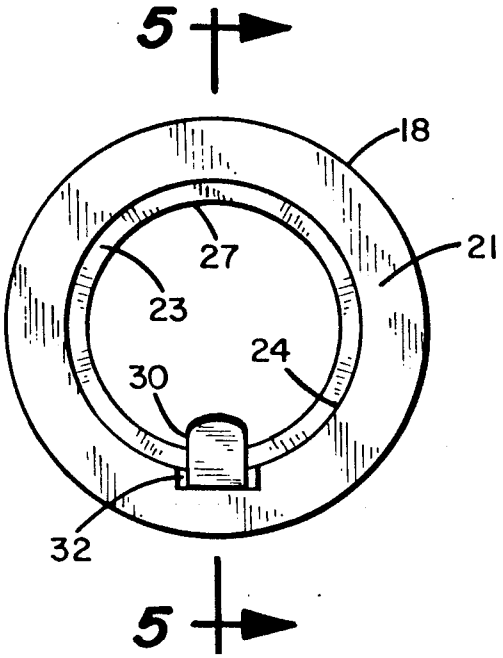
FIG. 4 is an end view of a warm-up weight of a second embodiment from the open end of the cylindrical section.
Figure 5:
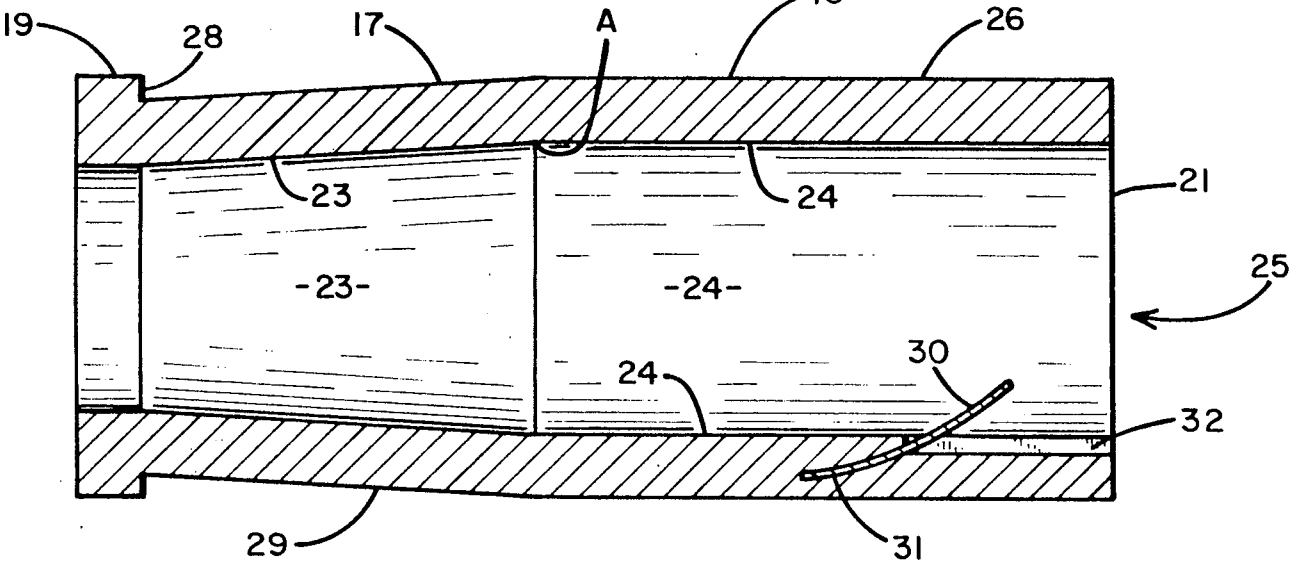
FIG. 5 is a cross-section view taken along the line 5—5 of FIG. 4.

As shown in FIGS. 4 and 5, near the distal end 21 of the cylindrical section 18, the warm-up weight includes a uni-directional insertion safety member 30. The safety member depicted is an elongated leaf-type spring, one end 31 of which is attached to or embedded in the wall of section 18. The safety member or a portion thereof extends generally toward the distal end 21 and generally inwardly from inner surface 24 into the bat receiving bore 25. It extends into the bore a sufficient distance to prevent the insertion of the barrel end 15 of a bat into the warm-up weight, yet permits the insertion of knob end 13 of a bat. After the knob end is inserted, continued insertion of the conical portion 14 of the bat forces the safety member 30 into a safety member receiving notch 32 in the inner cylindrical surface 24.

Figure 3:
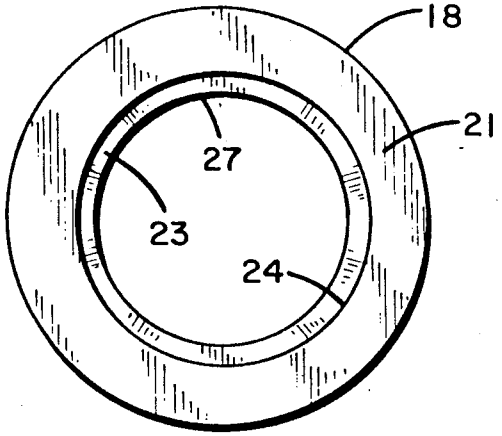
FIG. 3 is an end view from the open end of the cylindrical section of a warm-up weight of one embodiment.

As shown by FIGS. 2 and 3, the diameter of the cylindrical section 18 as measured by the inner peripheral surface 24 is typically approximately two and nine-thirtyseconds inches (2 9/32") at any lateral cross-section from the transitional section 22 to distal end 21. The diameter of the cylindrical section 18 measured by an outer, peripheral, cylinder surface 26 of the cylindrical section 18 is typically approximately three and nine-thirtysecondths inches (3 9/32") at any lateral cross-section from transitional section 22 to distal end 21.

The diameter of the conical section 17 as measured by the inner peripheral surface 23 at an handle or boss end 27 is typically approximately one and fifteen-sixteenths inches (1 15/16"). The diameter of the boss 19 as measured by an outer peripheral surface 28 thereof is typically approximately three and nine-thirtyseconds inches (3 9/32").

The thickness of the boss 19 is typically approximately eleven-sixteenths of an inch (11/16"). The width of the boss 19 is typically approximately one-half inch (½").

The thickness of each of the sections 17–18 is typically approximately 0.44 inch The distance from transitional section 22 to distal end 21 is typically approximately four and one-half inches (4½"). The distance from transitional section 22 to handle or boss end 27 is typically approximately three and one-half inches (3½") along a central axis B of cylindrical section 18 when the axis B is extended through the conical section 17. Of course, either the thickness or the respective lengths may be varied to change the overall weight of the apparatus, or to redistribute the weight over the length of the apparatus.

The weight of the warm-up weight 10 for men is typically approximately one and one-half pounds (1½ lbs.) to two pounds (2 lbs.). The weight of the warm-up weight 10 for women is typically approximately one pound (1 lb.) to one and one-half pounds (1½ lbs.). In general, the weight of the warm-up weight 10 varies from one to two pounds. The warm-up weight 10 may be formed of polyvinylchloride (PVC), or other materials having greater or lesser weight density.

It should be noted that a warm-up weight 10 intended for use in a men's league may be converted to use in a women's league simply by shaving the exterior peripheral surface 26 of cylindrical section 26 and an exterior, tapering, conical surface 29 of the conical section 17. The diameters of each of the sections 17–18 as measured by their inner peripheral surfaces may remain the same for both men's and women's warm-up weights 10.

In operation, a batter inserts the knob end 13 of the softball bat 11 in the bore 25 at the distal end 21 of the warm-up weight 10. The batter continues to slide the softball bat 11 through the warm-up weight 10 until the inner, tapering, conical surface 23 is wedged against the tapering portion 14 of the softball bat 11. When the tapering surface 23 is wedged against the tapering portion 14, the cylindrical section 18 extends over a part of the barrel portion 15 of the softball bat 11. The batter may tap the distal face 16 of the softball bat 11 against the ground to further wedge the conical section 17 tighter against the tapering portion 14 and closer to distal end 16. As the batter swings the softball bat 11 during his or her warm-up in the on-deck circle, the conical section 17 may be still further wedged upon tapering portion 14 and still closer to distal end 16 by centrifugal force urging the warm-up weight 10 outwardly in relation to the knob 13. Since the mass or weight of the elongate warm-up weight 10 is distributed substantially evenly, a balanced bat may be maintained for the batter's warm-up swings. After the batter is loosened up and before he or she enters the batter's box, he or she may dislodge the warm-up weight 10 from the softball bat 11 by tapping the knob 13 on the ground. The boss 19 offers annular strength against breakage to the warm-up weight 10 as it is dislodged and hits the ground.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A warm-up weight for a standard softball bat, the softball bat including a conical section defining a proximate handle portion and a cylindrical section defining a distal ball hitting portion, the warm-up weight comprising:

a) a hollow open-ended cylindrical elongate integral section having an inner surface for extending over, conforming to, and bearing against the cylindrical portion of the softball bat, a leaf spring member having an end affixed to said inner surface, said spring member having a free end extending away from said inner surface and directed toward one end of said cylindrical section;

b) a hollow conical elongate integral section attached to the other end of said cylindrical section for fitting over and being wedged against the conical section of the softball bat, said conical section being integrally connected to said cylindrical section to provide a removable warm-up weight.

2. A warm-up weight for a standard softball bat, the softball bat including a conical section defining a proximate handle portion and a cylindrical section defining a distal hitting portion having a distal end, the warm-up weight comprising:

a) a hollow cylindrical elongate integral section for extending over, conforming to, and bearing against the cylindrical section of the softball bat, said cylindrical section having an open distal end, b) a conical elongate integral section for fitting over and being wedged against the conical portion of the softball bat, said conical section being integrally, connected to one end of said cylindrical section to provide a removable warm-up weight, and c) a safety member affixed to the inner surface of said cylindrical section intermediate the ends thereof for preventing the complete insertion of said distal end of the bat through the entire length of said cylindrical section of said warm-up weight.

3. The warm-up weight of claim 2, wherein said safety member extends generally and sufficiently toward the central axis of said cylindrical section a predetermined distance to prevent the insertion of said distal end of the bat into said cylindrical section if said distal end is attempted to be inserted before said handle portion.

4. The warm-up weight of claim 2, wherein said safety member is an elongated leaf-spring member.

5. The warm-up weight of claim 3, wherein said safety member is an elongated leaf-spring member.

6. The warm-up weight of claim 2, wherein an annular boss is integrally connected to the smaller end of said conical section.

* * * * *